US007586463B1

(12) United States Patent
Katz

(10) Patent No.: US 7,586,463 B1
(45) Date of Patent: Sep. 8, 2009

(54) EXTENDABLE HELICAL ANTENNA FOR PERSONAL COMMUNICATION DEVICE

(75) Inventor: Daniel A. Katz, 87 Tzahal st., Kiryat Ono (IL) 55451

(73) Assignee: Daniel A. Katz, Kiryat-Ono (IL)

( * ) Notice: Subject to any disclaimer, the term of this patent is extended or adjusted under 35 U.S.C. 154(b) by 0 days.

(21) Appl. No.: 12/344,469

(22) Filed: Dec. 27, 2008

(51) Int. Cl.
*H01Q 1/50* (2006.01)
*H01Q 1/12* (2006.01)

(52) U.S. Cl. ..... 343/895; 343/718; 343/828; 343/829; 343/867

(58) Field of Classification Search ..... 343/718
See application file for complete search history.

(56) References Cited

U.S. PATENT DOCUMENTS 2,982,964 A * 5/1961 Bresk et al. ..... 343/895
5,216,436 A 6/1993 Hall et al.
5,721,558 A 2/1998 Holemans
5,909,197 A 6/1999 Heinemann et al.
6,791,508 B2 * 9/2004 Berry et al. ..... 343/895
2008/0106485 A1 * 5/2008 Huang et al. ..... 343/895

* cited by examiner

*Primary Examiner*—Trinh V Dinh

(57) ABSTRACT

The present invention discloses a portable personal communication device with an extendable helical antenna. This helical antenna is made of an elastic conductive spring, configured to change its height over a ground plane and along the antenna axis, mainly having two positions: a stowed position where the antenna is pressed down between the ground plane and a rigid cover, achieving a low profile; and an operational position where the rigid cover is removed and the antenna is extended by its own spring force, to a higher height, improving antenna gain. Normally, a second planar antenna may be placed over the same ground plane, not exceeding the footprint of the helical antenna, thus utilizing a compactly small volume and yet achieving a considerable electromagnetic decoupling between the antennas, due to their different radiation patterns. According to one embodiment, these antennas are installed in a Personal Locator Beacon (PLB) for Search and Rescue (SAR) of people in distress, where the planar antenna is coupled to a Global Navigation Satellite System (GNSS, such as GPS) receiver, and the helical antenna is coupled to a VHF/UHF radio.

19 Claims, 6 Drawing Sheets

Figure 1 – Cylindrical Helical Antenna in Stowed and Extended Positions

Stowed Antenna
(Case and Cover not shown)

Stowed Antenna
(Transparent Case and Cover)

Stowed Antenna
(Inside Case and Cover)

Extended Antenna
(Case and Cover not shown)

Extended Antenna
(Cover Removed)

Figure 2 – Hemi-Spherical Helical Antenna in stowed and extended positions
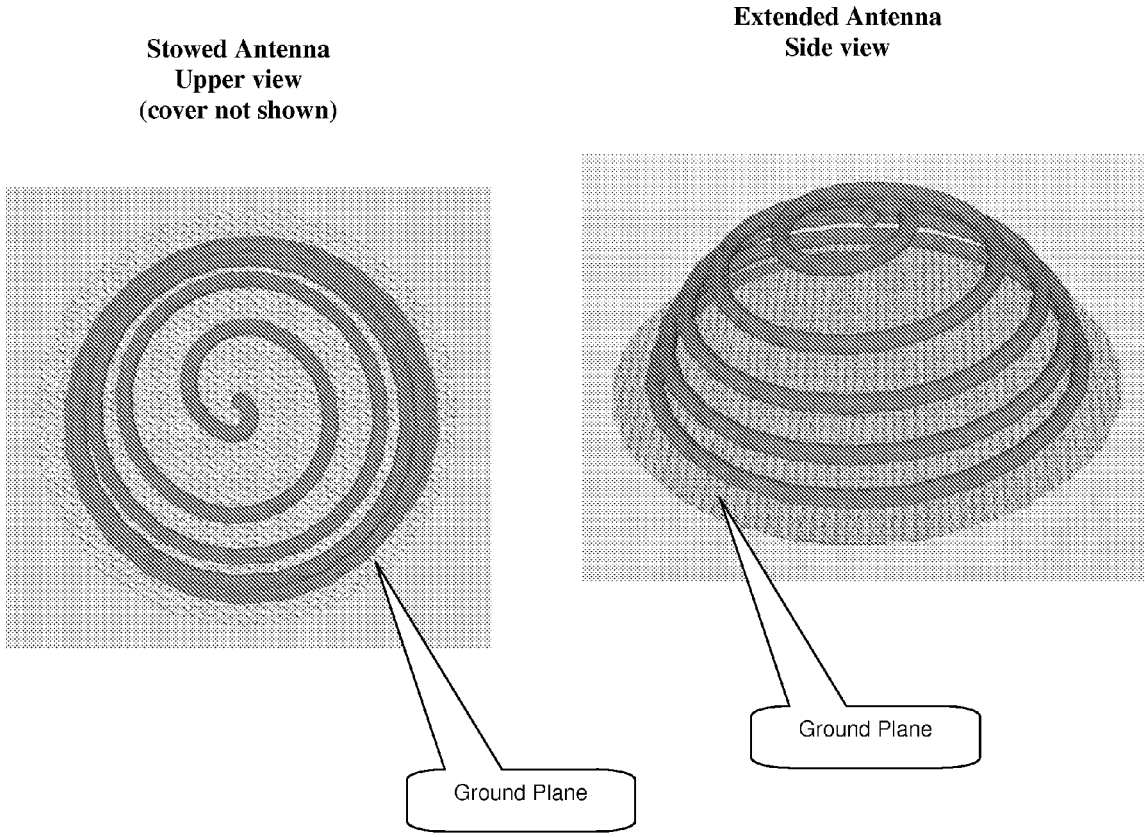

Figure 3 – Collocating Two Antennas According to the Present Invention
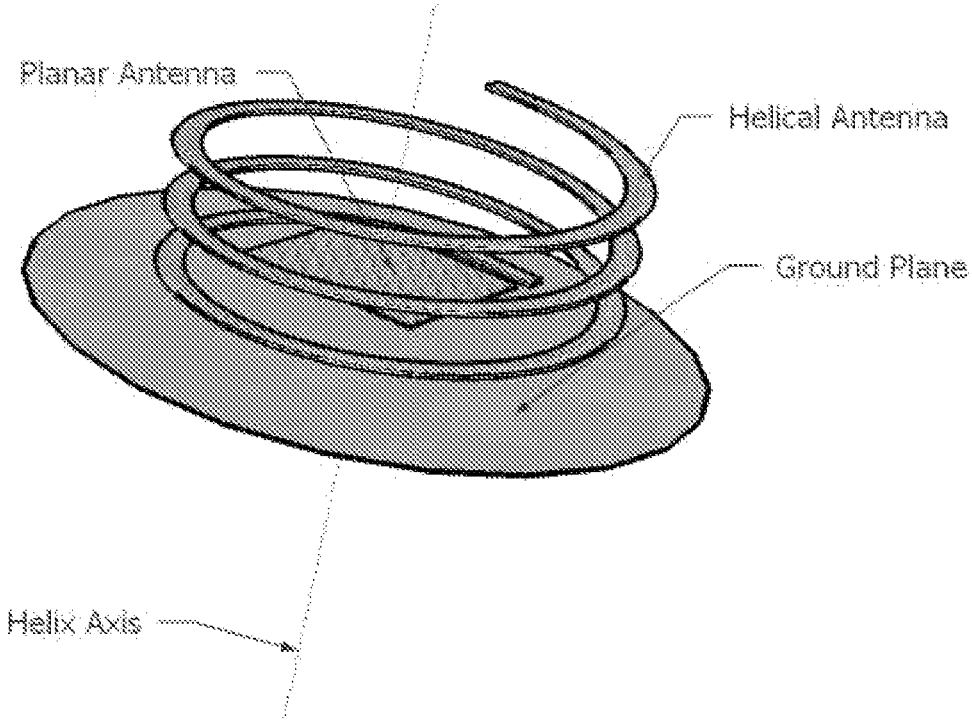

Figure 4 – Wearing the device on the wrist
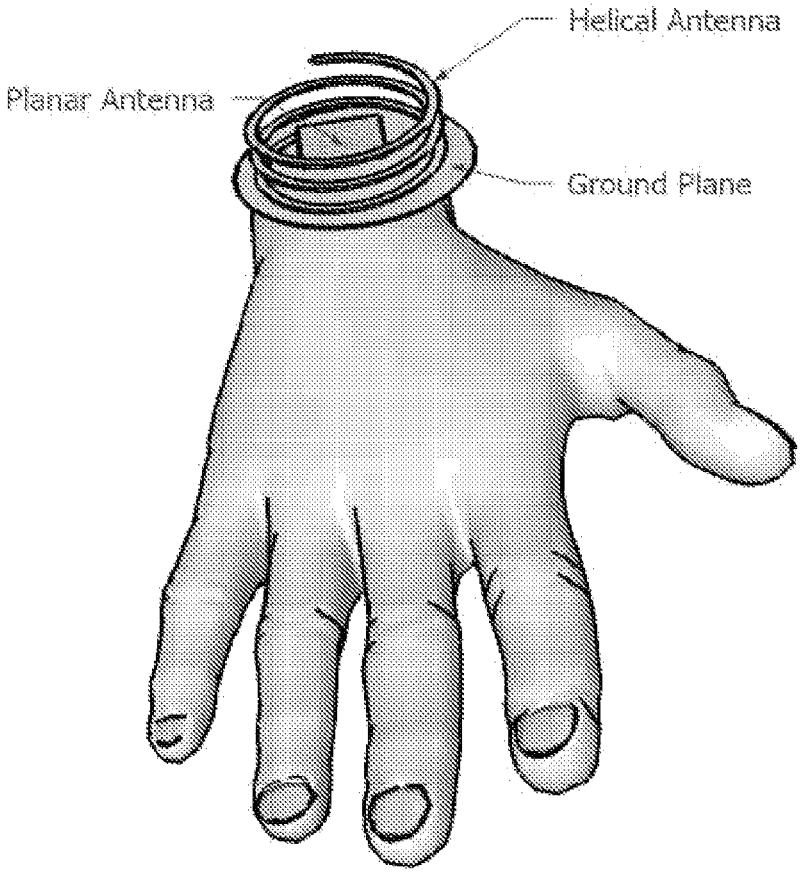

Figure 5 – Overview of the Disclosed Device
in Relation to Positioning and Distress Satellites
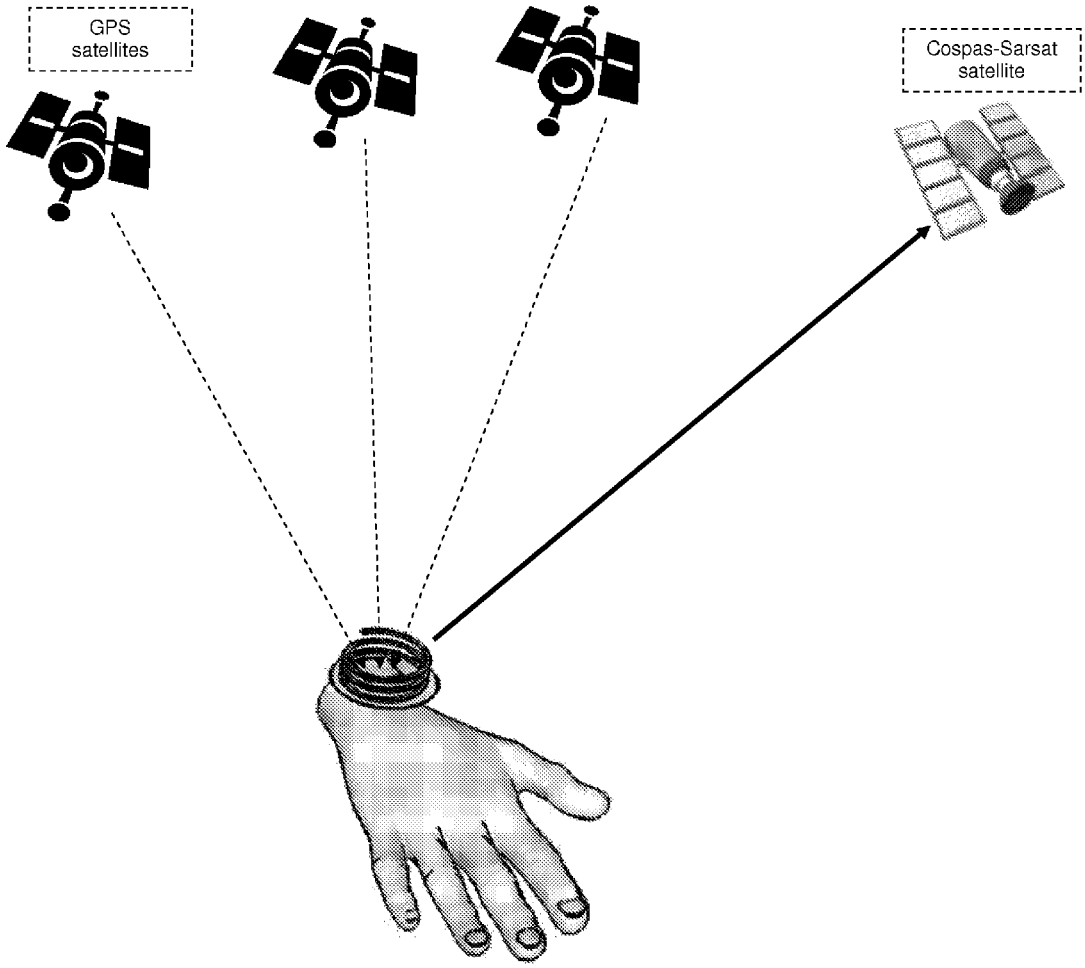

Figure 6 - Block Diagram of a Communication Device coupled with Two Antennas
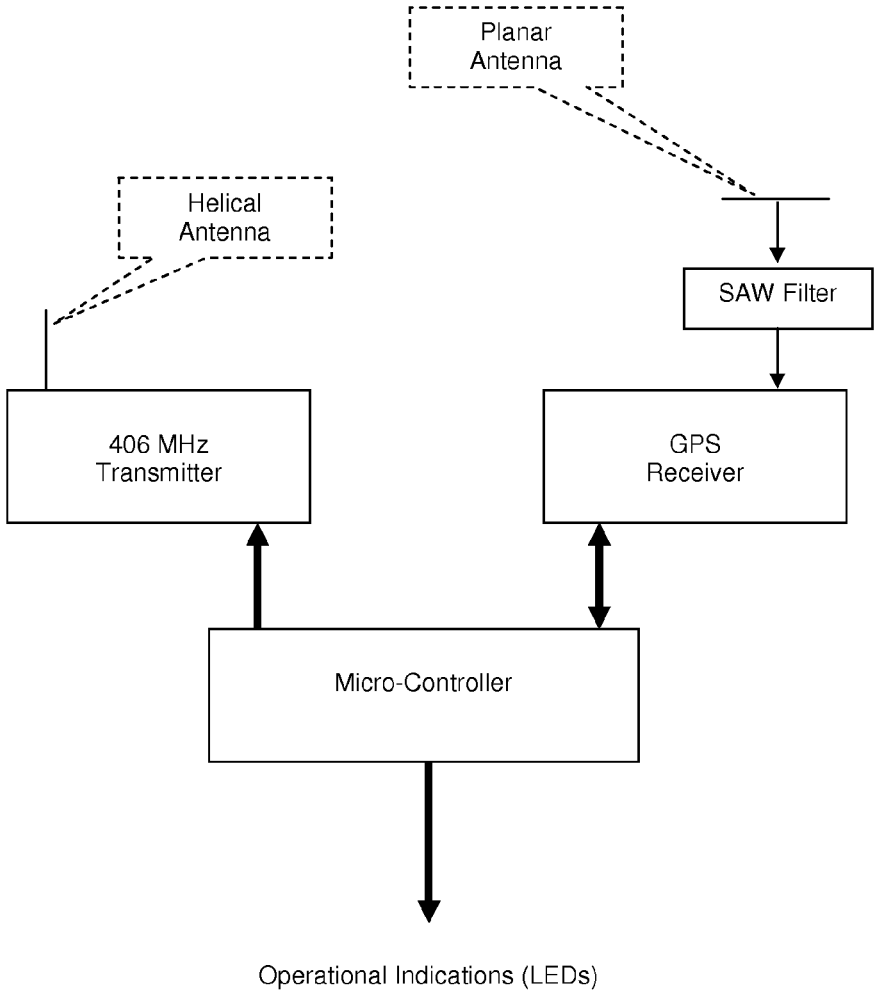

EXTENDABLE HELICAL ANTENNA FOR PERSONAL COMMUNICATION DEVICE

BACKGROUND OF THE INVENTION

Efficiency of an antenna is usually defined as the ratio between the power the antenna radiates and the power put into the antenna by a coupled transmitter. Obviously, a high efficiency is usually desirable in an antenna.

The physical size of an antenna, normalized to its operating wavelength, is usually referred in the art as the "electrical size" of the antenna, so a "small antenna" usually means an Electrically Small Antenna (ESA). Clearly, small antennas are desirable, particularly in mobile device.

In addition, embedding an antenna in a substrate obtaining a dielectric constant larger than 1 (which is the dielectric constant in free space, and approximately the dielectric constant in air), can reduce the antenna size, for a given efficiency, by the square root of the substrate dielectric constant. Yet, in the present document, a dielectric constant of 1 is assumed, unless specified otherwise.

Ideally, a small and efficient antenna should be designed for most wireless devices, however, a well known rule of thumb trades off between these two parameters, limiting the miniaturization of the electrical size of an antenna, for a given efficiency. Basically, this rule dictates that at least one of the antenna dimensions should be not less than $\frac{1}{4}\lambda$, where $\lambda$ (lambda) is the transmission (or reception) wavelength, to achieve efficient radiation.

This rule is well reflected in one dimensional antennas ("whip" or "rod" shaped) such as $\lambda/2$ dipoles and $\lambda/4$ monopoles (the latter normally placed over a ground plane). For example: a $\lambda/2$ dipole of 37 cm for 406 MHz (for emergency radio beacons); a $\lambda/4$ monopole of 1 meter for 156.8 MHz (channel 16, for distress safety and calling in the marine VHF band).

Also two dimensional antennas (planar antennas) such as patch or microstrip, reflect this rule. For example: a $\lambda/2$ patch antenna of 6×6 cm for 2.4 GHz (WiFi); ~3×3 cm for 1.575 MHz (GPS-L1), on a high dielectric substrate.

Three dimensional antennas also reflect this rule. For example, efficient axial mode helical antennas typically obtain a coil diameter of $\lambda/3$.

Clearly, smaller than $\lambda/4$ antennas can be tuned for a specific frequency, yet this usually degrades the antenna efficiency. Thus, an efficient antenna for a relatively low frequency (i.e. long wavelength) is not easily achieved in small dimensions. Practically, in mobile or portable communication devices, this limitation is particularly relevant to UHF, VHF and lower frequency bands.

Over the years, more complex shapes of antennas, many of them three dimensional, were been studied. Some fundamental works were been published by Wheeler [H. A. Wheeler, "Fundamental Limits of Small Antennas," Proceedings of The I.R.E. (IEEE), December 1947, pg. 1479-1484], Chu (Chu, L. J, "Physical Limitation of Omni-Directional Antennas", Journal of Applied Physics, Vol. 19, p. 1163-1175, December 1948) and others. Based on these works, theoretical arguments predict that the minimal size for practical antennas will require a volume of half a sphere with a radius r, where $kr=0.3$ ($k=2\pi/\lambda$). For example, at 406 MHz this means a radius r of ~4 cm.

Still, not surprisingly, some communication devices employ antennas configured for two positions: a stowed position, where the antenna is usually retracted or coiled or folded in a compact way, and an operational position, typically less often used, where the antenna is extended to a larger size, in order to improve its gain.

The size issue becomes much more challenging when two or more antennas are required to be placed in the same communication device. Then, each of the antennas has its size reduction limitations, as discussed above, but also, the electromagnetic coupling between the antennas is important, as one antenna might load and reduce the performance of another, if collocated too close. For the purpose of simplicity, the discussion hereby will be limited to two antennas collocated in the same device, however as a skilled person may appreciate, this may be broadened to more than two antennas.

A typical example for a small wireless device employing two antennas is a personal device obtaining one antenna to receive Global Navigation Satellite System (GNSS, such as GPS) signals, and another antenna to communicate over VHF/UHF bands, in order to report its location. It is estimated that more than a hundred millions of mobile (cellular) devices presently comprise a GPS receiver for navigation or Location Based Services (LBS), in additional of course to a UHF (e.g. 900, 1800 or 1900 MHz) cellular transceiver.

Devices that confront the antenna size issue more seriously, due to a lower operation frequency, are distress radio beacons operating on 406 MHz. Such a device, also known as PLB (Personal Locator Beacon), is designed to be carried by a person, and operate in case of emergency. When activated, the PLB repeatedly transmits short data bursts at 406 MHz, indicating the beacon Identification Data (ID) and its location. Since such PLBs are to be detected by satellites, including satellites orbiting 35,000 Kilometers above the earth, and since the PLB output power is only 5 watts to enable a reasonable operation time on batteries, an efficient antenna is required. Thus, many PLBs use a ½ lambda dipole antenna, about 37 centimeters long. Such are PLBs which are compatible with the Cospas-Sarsat Search and Rescue (SAR) satellite system. Though the present invention is not limited to this specific system, Cospas-Sarsat is a good example to clarify the present art, its limitations and the present invention, so it is specifically enlightened here.

Cospas-Sarsat is a satellite communications system to assist SAR of people in distress, all over the world and at anytime. The system was launched in 1982 by the USA, Canada, France and the Soviet Union (Russia) and since then, it has been used for thousands of SAR events and has been instrumental in the rescue of over 24,000 lives worldwide. The goal of the system is to detect and locate signals from distress radio beacons and forward the data to ground stations, in order to support all organizations in the world with responsibility for SAR operations, whether at sea, in the air or on land. The system uses spacecraft —Low Earth Orbit (LEO) and Geostationary (GEO) satellites; and in the future also Medium Earth Orbit (MEO) satellites; Cospas-Sarsat radio beacons transmit in the 406 MHz band (and 121.5 MHz until 2009). The position of the beacon is determined either by the Doppler shift of the received beacon signal or by position data modulated on the signal, provided by a GNSS receiver integrated in the radio beacon.

A detailed description of the Cospas-Sarsat System is provided in the document "Introduction to the Cospas-Sarsat System, C/S G.003", accessed through—http://cospas-sarsat.org/Documents/gDocs.htm All Cospas-Sarsat beacons are subject to the same basic RF specifications, yet may employ a different mechanical structure and different activation method, possibly also slight differences in the data modulated on the signal, usually adopted to different applications, and named accordingly: a) Emergency Position Indicating Radio Beacon (EPIRB) for marine use; b) Emergency Locator Transmitter (ELT) for aviation use; and c) Personal Locator Beacon (PLB) for personal and/or terrestrial use. For the purpose of the present invention, the name "PLB" is mainly used, however it refers to any type of radio location beacon (not necessarily related to "persons").

State of the art PLBs are in the size of a PDA (i.e. a palm top computer) or a "walkie-talkie", designed to be hand held and require extending the antenna, about 37 centimeters long, when operating the device. Clearly, holding an operating PLB, with its antenna extended and kept substantially vertically to enable good transmission conditions, might well disturb a person in distress. Normally, a person in distress has further tasks to do beyond holding the beacon in a certain position; such a person might need his hands free to swim or run or row or climb, in addition to keeping the PLB nearby.

A possible solution for a PLB attached to a person in distress, enabling hands free operation, is a wrist-worn PLB. Yet, fitting a proper antenna to a wrist-worn PLB is not easy, due to the electrical size of a 406 MHz antenna and considering the interfering of the human body to RF radiation.

One solution for an antenna for such a wearable PLB was already considered by the applicant, who proposed a "Wrist Worn Communication Device coupled with Antenna Extendable by the Arm", U.S. patent application Ser. No. 11/938,311, filed on 12 Nov. 2007.

Another type of devices that require small yet efficient antennas is devices for man overboard (MOB), i.e. a device worn by a person enabling his rescue upon accidently falling overboard a vessel in the open sea (or ocean, or lake, or river, etc.). Fast detection and location of such accidents is crucial, since survival time in water is limited, typically less than 2 days at ~20° C. and less than 6 hours at ~10° C.

Basically, an MOB device may comprise an RF transmitter, possibly also a GNSS receiver, in a small housing preferably worn on the wrist or the arm. On the ship, a compatible receiver is standing-by to detect signals from such a worn device, indicating the presence of the MOB. Clearly, a worn device should be small enough to enable continuously wearing it onboard. Furthermore, the device should obtain a transmission range long enough to be detected by its vessel or by a SAR team, even at low communications and low visibility conditions. Present devices usually operate on unlicensed bands, thus restricted to a low transmission power (typically less than 100 mw), so consequently obtain a poor transmission range. Therefore, an efficient antenna, yet in a small and user friendly device is probably desirable for any such MOB device.

U.S. Pat. No. 7,424,316 to Boyle discloses a Body-worn personal communications apparatus. According to Boyle, the antenna is mounted in the device such that one dimension of said antenna is aligned with the height of the device casing, and is designed so as to not require manipulation by a user. Boyle also discloses that this antenna is a helical antenna.

Boyle discloses a helical GSM antenna at 900 MHz, of 5 mm diameter and 10 mm height. Yet, an efficient antenna for a lower frequency would probably be bigger. Furthermore, Boyle refers only to a single antenna for a body-worn device, however when an additional antenna is required, such as for GPS, volume and area limitations become stricter.

Helical antennas provide significant advantages relevant to body worn communication devices, as well as for satellite communications, specifically due to the antenna circular polarization. However placing two helical antennas in a small communication device, particularly dealing with lower than GSM frequencies, would hardly enable a compact design and electromagnetic decoupling between the antennas.

U.S. Pat. No. 5,852,401 to Kita (Casio), discloses a wrist-watch type distress message sending device worn by the user. The device comprises a GPS receiver, at least two sensors, distress signal generating means and a radio for sending the distress signal. The radio sending antenna is preferably a helical antenna contained in the watch body or alternatively, a helical whip antenna extending from the watch body. The GPS antenna, according to Kita, is planar and placed in the wristband of the watch. Kita fails to teach how such a helical whip antenna is installed in the watch, or extend from the watch. Furthermore, Kita fails to teach if this whip antenna is a dipole or monopole, and also fails to teach a proper ground plane, in case of a monopole.

U.S. Pat. No. 4,673,936 to Kotoh (Mitsubishi), discloses a small-size transmitting apparatus for search and rescue operation (SARTR) adapted to be worn by a user for emitting a microwave rescue signal upon a marine accident involving the user. Kotoh discloses a device operating on microwaves, typically on the 9 GHz band, where ½ lambda is less than 2 cm; however, for VHF/UHF, where antenna size is significantly bigger, this invention would require a different antenna design.

U.S. Pat. No. 5,559,760 to Schneider (Breitling), discloses a wristwatch comprising, in addition to a device for measuring and displaying the time, a high-frequency transmitter and an extensible antenna in the form of two wires wound up in two different housings of the watch before use; the antenna being unfurled by pulling on plugs fastened to each end of the antennas. The dipole antenna of this device is configured that once been extended, does not flex but remains straight. This method might be problematic since such a whip dipole antenna is quite long for VHF/UHF bands.

U.S. Pat. No. 6,987,708 to Megner et al., discloses an emergency call transmitter adapted to be attached in a threaded recess of a wristwatch housing, the call transmitter comprising a transmitter housing carrying an emergency signal-emitting mechanism, and an extractible antenna, wound up at first in said housing. This device also requires a quite inconvenient manipulation of the antenna to be placed in a proper transmission position, and as the antenna is extended, it would probably disturb the operator from freely move his hands.

The paper "Low Profile Integrated GPS and Cellular Antenna", by Nathan P. Cummings, is a thesis submitted to the Faculty of the Virginia Polytechnic Institute and State University in partial fulfillment of the requirements for the degree of Master of Science in Electrical Engineering. See—http://scholar.lib.vt.edu/theseslavailable/etd-11132001-145613/unrestricted/etd.pdf. This paper presents a design for a compact, low profile antenna unit, operating at both the cellular band of 824-894 MHz and the GPS L1 frequency of 1575 MHz. The combined antenna unit is less than 10 cm in diameter and less than 5 cm in height. The two collocated antennas comprised in this unit are: a) a Planar Inverted F Antenna (PIFA), for cellular communications; and b) a patch antenna, for GPS, located on top of the PIFA. Scaling the PIFA dimensions for lower frequencies, such as 406 MHz instead of 850 MHz, would make it twice as big.

U.S. Pat. No. 5,909,197 to Heinemann et al. discloses a Deployable helical antenna stowage in a compact retracted configuration. Heinemann discloses a compressible and deployable antenna comprised of a top and a bottom plate, and a deployable structure fitted between the plates which can forcibly separate the plates and extend a helical antenna placed between the plates. Yet, Heinemann teaches that the force means to extend the antenna comprise spring-like members in radial slots in the inner side of said plates, whose bias is toward the axis.

U.S. Pat. No. 5,721,558 to Holemans also discloses a Deployable helical antenna. This antenna, mainly designed for spacecraft, as Heinemann's antenna, is configured to collapse to a stowed position, and deploy by means of springs and guiding plates, however not solely by own antenna spring force.

U.S. Pat. No. 5,216,436 to Hall et al. disclose a Collapsible, low visibility, broadband tapered helix monopole antenna. The antenna is comprised of a conductor formed as a tapered helix, which extends along an axis from a first helix diameter portion to a second helix diameter portion larger than said first helix diameter portion, and a plurality of electrically conductive attachment elements, which attach different helix diameter portions to one another; when allowed to expand toward its deployed configuration, these elements limit the expansion of the antenna.

The present art methods described above have not yet provided a satisfactory solution to the problem of a portable communication device, operating on a relatively low frequency, obtaining a compact size yet efficient antenna.

Furthermore, the present art methods described above have not yet provided satisfactory solutions to the problem of a small communication device with two efficient antennas, still compact enough to be carried routinely by a person.

It is the object of the present invention to provide a device and method for a small communication device coupled with one or two electrically efficient antennas, configured to be easily carried by a user, operated in a friendly manner and limiting as less as possible the user while the device is operating.

It is another object of the present invention to provide a device and method for collocating two antennas in a small volume, compared to the transmission wavelength, yet achieving a substantial electromagnetic decoupling between the antennas.

It is also an object of the present invention to provide a device and method for a communication device, comprising a GNSS (GPS) receiver with a matching antenna, and a VHF/UHF transmitter with a matching antenna, configured to be wrist-worn.

It is yet an object of the present invention to provide a device and method for a device comprising an antenna coupled to a transmitter, configured to transmit automatically from time to time, wherein the user is been indicated that the transmitter is about to be activated or is actually transmitting, and possibly also indicating a transmission acknowledgement, so the user could accordingly manipulate the device and antenna orientation in advance to increase the communication success probability.

It is yet another object of the present invention to provide a device and method for a wrist-worn emergency radio beacon, also known as a PLB, compatible with satellite systems such as COSPAS-SARSAT, coupled with an efficient RF antenna and a GNSS antenna, yet enabling as possible user activities such as swimming, skiing, climbing, rowing, and running.

It is still an object of the present invention to provide a device and method for a distress radio beacon, wearable by a person onboard a vessel and used for MOB Search and Rescue.

Other objects and advantages of the invention will become apparent as the description proceeds.

SUMMARY OF THE INVENTION

The present invention discloses a personal communication device comprising at least a helical antenna placed over a ground plane, packaged in a case with a rigid cover, said helical antenna axis substantially perpendicular to said ground plane and said helical antenna base substantially close to said ground plane, said ground plane size at least of a circle having a diameter not less than the helical antenna diameter (i.e. the diameter of the widest coil), said helical antenna made of an elastic conductive spring configured to change its height along its axis, at least: a) pressed down between said case and said cover achieving a low profile; or b) extended to a higher height improving antenna gain upon removing said cover, wherein the antenna is extended upon removing said cover only by means of its own spring force, and wherein the extended helical antenna radius is either constant or decreases as the distance from the ground plane increases.

It order to use the spring force to enable automatic extension of the antenna, the device is packaged in a case with a rigid cover, so when closed, the case and cover restrain the antenna, and upon opening the cover, the spring antenna automatically extends to form a predefined helical shape; this predefined helical shape is configured to support the device communication requirements, particularly matching the transmission and/or reception frequency and antenna gain. Configuring the ground plane as a circle having a diameter not less than the helical antenna diameter, and placing the helical antenna perpendicular and close to this ground plane provide a robust mechanical structure, supporting personal devices configured to be carried on the wrist or the arm, when the antenna is stowed and even when the antenna is extended. Advantageously, configuring the antenna coils radius to be constant or decrease as coils get apart from the ground plane, enables a very compact volume for stowing the antenna, which is made of an elastic spring so may be pressed down between the case (more specifically: the ground plane fixed to the case) and the cover, without losing its flexibility and ability to extend to its full predefined height, upon opening the cover.

Non limiting alternatives to the geometrical shape of the helical antenna according to the present invention include: a) Spherical Helix; b) Cylindrical Helix; c) Folded Spherical Helix; d) Folded Cylindrical Helix; e) Conical Helix; f) Bifilar Helix; g) Quadrifilar helical; or a combination thereof.

The helical antenna can be a simple spring made of one conductor coiled as a helix, or comprising multiple helical conductors, also known as arms, each arm coiled as a helix, around the antenna axis. The radius of these coils may be constant, forming a cylindrical helix; alternatively, the radius of these coils may vary in a way that consecutive coils of an extended arm decrease in radius as the distance from the ground plane increases, forming for example a conical or hemi-spherical helix.

According to the preferred embodiment of the present invention, the helical antenna is made of one conductor shaped as a spherical helix, hemi-spherical to be more precise, i.e. following a curve on a hemisphere surface. According to this embodiment, the radius of the helical antenna at its base, near the ground plane, is approximately equal to the radius of the sphere, then the helix radius gradually decreases as getting away from the ground plane, to a minimum at the most distant point away from the ground plane.

In order to mechanically support the extended antenna, it is possible to attach it to the case with at least one cord which is configured to be stowed when the antenna is pressed down, and maintain the antenna length and orientation substantially fixed referred to the case and the ground plane.

The round shape of the helix coils enables also a compact shape for the case and cover of this communication device. In particular, the cover may be round, like a disk, configured with a screw thread along its circumference and a matching screw thread on the case, enabling an operator to remove the cover from the case by turning it counterclockwise. Such an opening method, mostly familiar from daily life, is very helpful in case of distress, when the operator is required to act rapidly and intuitively.

The cover may also be configured to be removed automatically, upon sensing an environmental change. This way, a human intervention is not required to extend the antenna, so even if this device is attached to a person, the antenna could become operable even if this person is unconscious or overwhelmed. The sensor(s) that control(s) the cover opening can be configured to detect: temperature; humidity; water pressure; air pressure; electromagnetic radiation; vibration; acceleration; or a combination thereof.

For helical antennas, the electrical dimensions of the antenna determine one of two possible operating modes: normal mode or axial mode. In normal mode, the helix dimensions are small compared to the operating wavelength, which is usually desirable to achieve a small antenna; however in axial mode, where the helix dimensions are in the scale of the operating wavelength, the antenna produces circular polarization and its gain is much less sensible to its orientation, obviously desirable as well. For portable communication devices, which are in the focus of the present invention, both qualities are required for the antenna: small dimensions and good tolerance to antenna orientation. Particularly, these antenna parameters are important for a wrist worn device, which is one application that the present invention is concerned on. Therefore, a fair trade off between these two opposing parameters might be required.

Typically, axial mode requires a coil diameter of ~⅓λ. For Search and Rescue (SAR) beacons operating on 406 MHz, the wavelength λ=74 cm, so a true axial mode in this case would dictate a helical antenna with a diameter of ~25 cm, not so practical for a portable device, particularly not wrist worn. However, decreasing the antenna circumference to 25% of its wavelength would dictate, for λ=74 cm, an antenna diameter less than 6 cm, more practical for a wrist worn device. Such a diameter would place the antenna between the axial mode and the normal mode, producing an elliptical polarization, which can be seen as a superposition of a circular and a linear polarization. Then, if this antenna transmits, and a matching antenna that receives this transmission is configured for circular polarization (as is typically the case with space born antennas), it would also receive linearly polarized radiated components, as well as circular, so the total antenna gain could be acceptable.

Designing the antenna in dimensions associated with a non pure axial mode, i.e. moving towards the normal mode, provides a less directional and more omnidirectional radiation pattern, which is desirable for communicating with non stationary satellites. However, in order to achieve a fair antenna gain, for example not less than −3 dBi, the antenna height cannot be strongly reduced. An antenna height which does not exceed 25% of the wavelength can be, at λ=74 cm, as high as ~18 cm. Clearly, such an antenna is not compact enough to be carried continuously by a person, particularly not on the wrist or the arm. Thus, it is desirable to configure the antenna to stay stowed while not operative, and be extended for operation.

The winding sense of the helical coil determines the antenna right/left hand polarization. According to the preferred embodiment of the present invention, the helical conductor is coiled clockwise, producing Right Hand Circular Polarization (RHCP).

The ground plane on which the helical antenna is placed over enables implementing a monopole antenna, usually half the height of a similar dipole antenna, a principle well practiced in the art. Furthermore, the communication device disclosed in the present invention is particularly suitable to be worn on the wrist or the arm of a human operator, by placing the ground plane between the human body and the helical antenna. This way, a relatively low interfering from the human body is applied to the antenna, which is placed on the opposite side of the ground plane.

Typically, the helical antenna according to the present invention would be coupled to a radio, which is preferably a transmitter but alternatively a receiver or transceiver. Due to electrical size of antennas, the present invention is particularly efficient for VHF or UHF bands.

A particularly interesting embodiment of the present invention is a communication device comprising an RF transmitter coupled to a helical antenna, configured to transmit periodic distress messages, upon activation. Such a device may be a SAR radio beacon operating on 406 MHz (low UHF band), configured to communicate with at least one satellite orbiting above the earth, e.g. according to the Cospas-Sarsat system previously discussed. Such communication device can be configured to meet the specifications determined by Cospas-Sarsat for either one of: Personal Locator Beacon (PLB); Emergency Position Indicating Radio Beacon (EPIRB); Emergency Locator Transmitter (ELT); Ship Security Alert System (SSAS). Such an embodiment of the present invention would be elaborated further in the detailed description.

The present invention is also directed to a more integrated communication device, comprising a second antenna, in addition to the first helical antenna. Typically, this communication device comprises, in addition to a first radio (e.g. a UHF transmitter) coupled to a first helical antenna, a second radio coupled to a second antenna. Such second radio could be, but not limited to, a Global Navigation Satellite System (GNSS) receiver. As a skilled person probably appreciates, GNSS is usually a general term, as well as GPS (Global Positioning System) and SPS (Satellite Positioning System) and SNS (Satellite Navigation System); these acronyms may relate to particular systems such as the USA GPS or the Russian GLONASS or the European GALILEO. In the present scope, unless indicated otherwise, the terms GNSS and/or GPS usually relate to a general/generic satellite navigation system.

The second antenna assembled in the communication device according to the present invention is a planar antenna, placed over the same ground plane, this planar antenna substantially parallel to the ground plane and substantially close to this ground plane, wherein the footprint of the planar antenna on the ground plane does not exceed the footprint of the helical antenna base on the same ground plane.

This way, the helical antenna and the planar antenna are compactly collocated over the same ground plane, the second antenna inside the first antenna, utilizing a relatively small volume, yet achieving a considerable electromagnetic decoupling. This considerable electromagnetic decoupling is achieved due to the different nature of spatial radiation patterns of the antennas: the planar antenna radiates mainly in higher elevated angles (around the zenith), while the helix antenna is configured to radiate at lower elevated angles (around the horizon).

Non limiting examples of planar antennas according to the present invention include: patch; microstrip; chip; folded strip; loop; spiral; meanderline; L shaped; F shaped; T shaped; U shaped; slot; two dimensional helical; any two dimensional pattern; or a combination thereof.

Typically, as already indicated, a GNSS receiver may be coupled to said planar antenna. Then, in order to protect the sensitive GNSS receiver, when radiating high power from the helical antenna, a filter can be placed between the GNSS receiver and the planar antenna. A non limiting example for such a filter is a SAW (Surface Acoustic Waves) filter.

The communication device may further comprise output means, either audible or visible or touchable or a combination thereof, configured to signal the user that: a) the radio is about to transmit or/and is actually transmitting; or/and b) its radio transmission was been acknowledged. Such indications are paramount in distress conditions. Since the device transmits short bursts at periodic intervals, a proper indication may guide the user to improve the antenna orientation before transmission, for example, in order to improve communication success probability. Then, an acknowledgment of his transmission that is been received and displayed, may dramatically improve the moral of a person in distress, increasing his chance to survive.

A particular application for which the disclosed communication device may be configured to, is related to the accident known in the marine field as Man Over Board (MOB). For this purpose, the communication device can be configured to be worn by or attached to a person onboard a vessel, and when said person falls overboard, said device is configured to transmit emergency signals. Clearly, in order to improve the antenna gain and achieve a better communication success probability, it is mostly recommended that the antenna cover will be removed, letting the antenna to extend higher and obtain a higher gain. Then, it is possible to configure the cover to be manually removed, or alternatively, the cover can be configured to be removed automatically, after been immersed in water for a minimum period of time.

The invention is further directed to an antenna assembly comprising at least a helical antenna placed over a ground plane, packaged in a case with a rigid cover, said helical antenna axis substantially perpendicular to said ground plane and said helical antenna base substantially close to said ground plane, said ground plane size at least of a circle having a diameter not less than the helical antenna diameter, said helical antenna made of an elastic conductive spring configured to change its height along its axis, at least: a) pressed down between said case and cover achieving a low profile; or b) extended to a higher height improving antenna gain upon removing said cover, wherein the antenna is extended upon removing said cover only by means of its own spring force, and wherein the helical antenna radius is either constant or decreases as going far from said ground plane.

The invention is also directed to a method for fitting an antenna in a communication device, comprising the steps of:

i) providing a case and a matching rigid cover;

ii) providing a helical antenna made of an elastic conductive spring, placed over a ground plane;

iii) placing said helical antenna axis substantially perpendicular to said ground plane and said helical antenna base substantially close to said ground plane;

iv) configuring said ground plane to a size at least of a circle having a diameter not less than the helical antenna diameter;

v) configuring said antenna radius constantly or decreasing as going far from said ground plane;

vi) placing said antenna and said ground plane in said case, configuring said antenna height to vary along its axis, at least: a) pressed down between said case and said cover achieving a low profile; or b) extended to a higher height improving antenna gain upon removing said cover;

vii) configuring said antenna to extend to said higher height only by means of its own spring force, when the cover is removed.

Other objects and advantages of the invention will become apparent as the description proceeds.

BRIEF DESCRIPTION OF THE DRAWINGS

The above and other characteristics and advantages of the invention will be better understood through the following illustrative and non-limitative detailed description of preferred embodiments thereof, with reference to the appended drawings, wherein.

Figure 1A:
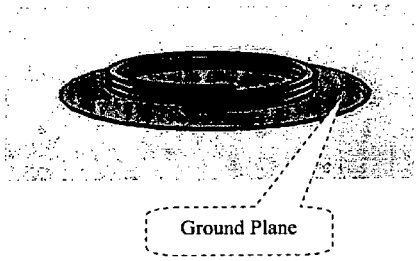
FIG. 1 shows a cylindrical helical antenna in two different positions: stowed and extended.

Three illustrations depict the stowed antenna, wherein accordingly:

a) case and cover are not shown to disclose the antenna and ground plane configuration b) case and cover are shown transparently to disclose the antenna and ground plane configuration:

c) case and cover are shown, yet the internal antenna and ground plane are not shown.

Three illustrations depict the extended antenna wherein accordingly:

a) case and cover are not shown;

b) case is shown however cover is removed.

FIG. 2 shows a hemi-spherical helical antenna in two positions (case and cover not shown): stowed (upper view); and extended (side view). The antenna is placed over a ground plane, obtains five coils, coiled over the surface of a sphere, where the lower coil, near the ground plane, has the largest radius, about the radius of the sphere, then the coil radius decreases as getting away from the ground plane.

FIG. 3 shows two collocated antennas according to the present invention: a helical antenna and a planar antenna placed over a ground plane. The picture depicts the helical antenna axis perpendicular to the ground plane, the helical antenna base close to the ground plane and the planar antenna parallel and close to the same ground plane.

FIG. 4 shows the assembly of two antennas placed on the wrist, according to the preferred embodiment of the present invention. The figure depicts the ground plane placed between the wrist and the helical antenna, and a planar antenna placed also over this ground plane.

FIG. 5 shows an overview of the disclosed device in relation to positioning and distress satellites. The figure shows two antennas in a wrist worn communication device, over a ground plane; the planar antenna is depicted to receive signals transmitted by three GPS satellites, and the helical antenna is shown to transmit signals to a Cospas-Sarsat SAR Satellite.

Not shown in this figure are the radio transmitter coupled to the helical antenna, and the GPS receiver coupled to the planar antenna.

FIG. 6 shows a block diagram of a communication device coupled with two antennas, according to a preferred embodiment of the invention. The figure depicts a microcontroller coupled to a GPS receiver and to an RF transmitter in the 406 MHz band. The GPS receiver is coupled to the planar antenna, however via a SAW filter, and the RF transmitter is coupled to the helical antenna. The microcontroller is also depicted to output operational indications, by means of LEDs. These LEDs can indicate that the device is about to transmit or is actually transmitting, and that a transmission was been acknowledged.

DETAILED DESCRIPTION

The present invention discloses a personal communication device comprising at least a helical antenna placed over a ground plane, packaged in a case with a rigid cover, said helical antenna axis substantially perpendicular to said ground plane and said helical antenna base substantially close to said ground plane, said ground plane size at least of a circle having a diameter not less than the helical antenna base diameter, said helical antenna made of an elastic conductive spring configured to change its height along its axis, at least: a) pressed down between said case and said cover achieving a low profile; or b) extended to a higher height improving antenna gain upon removing said cover, wherein the antenna is extended upon removing said cover only by means of its own spring force, and wherein the extended helical antenna radius is either constant or decreases as the distance from the ground plane increases.

Figure 1B:
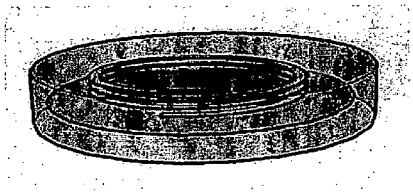
Figure 1C:
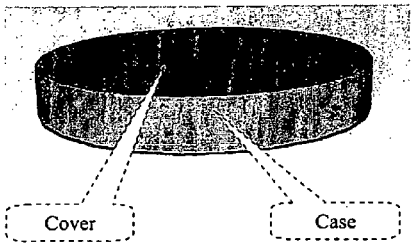
Figure 1D:
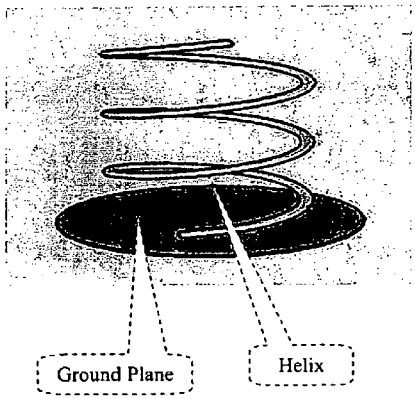
Figure 1E:
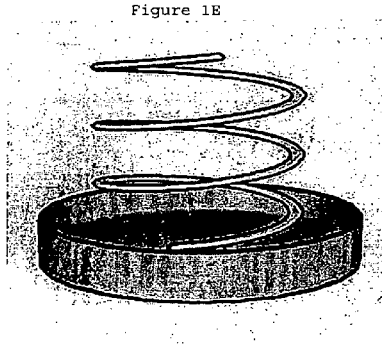

FIG. 1 show a cylindrical helical antennas in two different positions: stowed and extended. Three illustrations depict the stowed antenna: without case and cover, with transparent case and cover; and case and cover obscuring the internal antenna configuration. Two other illustrations depict the extended antenna: without case and cover; with case however no cover. As a skilled person may appreciate, the case is not mandatory transparent or cylindrical; the case is not bound to any particular shape or color or material, as long as it properly contains the stowed antenna and ground plane. Nevertheless, the case and cover are rigid in order to restrain the antenna spring force; when the cover is open, the antenna is free to extend to its predefined height, to achieve proper frequency matching and gain. The height of the case from the ground plane to the cover can be approximately the height of the stowed antenna, preferably low in profile to be conveniently worn on the wrist or arm. Actually, in a stowed position, if the antenna coil diameter is constant, the stowed antenna height can be as low as the antenna wire diameter multiplied by the number of coils as shown in FIG. 1 (upper left side); for example, a cylindrical helical antenna of 5 coils made of 0.7 mm diameter wire may be stowed to 3.5 mm height. Furthermore, if the coil diameter decreases as getting away from the ground plane, the stowed antenna height can be as low as the antenna wire diameter, as illustrated in FIG. 2 (left side); for example a conical helical antenna of 5 coils made of 0.7 mm diameter wire may be stowed to 0.7 mm height.

The ground plane is the upper layer of a Printed Circuit Board (PCB), typically having about 1 mm of thickness, and at least two conductive layers, from which the upper layer is a large conductive surface bearing a ground potential. Additional components implementing other parts of the communication device, such as receiver or transmitter, possibly also batteries, may be placed on the lower side of this PCB yet are not shown in FIG. 1.

As a skilled person may appreciate, placing the helical antenna axis perpendicular and close to the ground plane not only contributes to the radiation pattern of the antenna but also serves the mechanical robustness of the antenna assembly. The same applies to configuring the ground plane as a circle having a diameter not less than the helical antenna diameter. Particularly, this configuration supports personal and mobile embodiments of the communication device. The spring qualities of the antenna are achieved, as a skilled person may appreciate, by using an elastic metal wire, coiled at a specific helical parameters. Basically, for a specific material and diameter of wire, the coils diameter must not go over a certain value and not go under another value, and the pitch (distance between consecutive coils) must not exceed a certain parameter, otherwise the helical wire will loose its spring behavior. According to the preferred embodiment, the antenna is made of a stainless steel 17-7PH wire, 0.7 mm in diameter, coated with zinc, to enable soldering. The typical pitch is about 10 mm and the spring rate, which characterizes its extension force, is approximately 0.029 N/mm.

As shown at the right side of FIG. 1 (extended antenna), the helical antenna is a simple spring made of one conductor coiled as a helix; alternatively (not shown) the antenna may comprise multiple helical conductors, each conductor coiled as a helix around the antenna axis. The radius of the extended antenna coils may be constant, forming a cylindrical helix, as shown in FIG. 1; alternatively, the radius of these coils may vary in a way that consecutive coils decrease in radius as the distance from the ground plane increases, forming for example a conical or hemi-spherical helix. FIG. 2 shows such a spherical helical antenna, actually semi-spherical or hemi-spherical like an Igloo, according to the preferred embodiment of the invention. The diameter of the widest coil, near the ground plane, is about 5 centimeters, the antenna obtains 5 coils and its extended position height is about 6 centimeters. The entire length of the coil is approximately 18 cm, i.e. approximately $\lambda/4$, since this antenna is tuned to 406 MHz ($\lambda$=74 cm). At this wavelength, 5 cm of diameter yield a circumference of ~6 cm, about $\lambda/5$, thus achieving a circumference and height less than 25% of the wavelength transmitted or received by this antenna. These dimensions place the preferred helical antenna somewhere between the axial and normal modes of operation. Thus, the antenna polarization is not purely circular, but having circular and linear polarization components, it actually obtains elliptical polarization. Still, the circular polarization component of this antenna is preferably RHCP, as indicated by the clockwise winding of coils (viewed from the feeding point, i.e. from the ground plane) shown in FIGS. 1 and 2.

Preferably, at least one non conductive cord is connected between one of the antenna coils and the case; said cord is configured to be stowed when the antenna is pressed down and mechanically support the antenna when extended. This cord or string is used to maintain the antenna length and orientation substantially fixed referred to the case and ground plane.

The round shape of the helix coils, either cylindrical or the spherical, well fits a round based case, and a matching round cover. In the preferred embodiment, the case is basically a cylinder, made of a plastic compound, where the cover is the cylinder upper base. Both the case and the cover are configured with a screw thread along their circumference, enabling an operator to remove the cover from the case by turning it counterclockwise. In addition, an O-ring is installed between the case and the cover to provide water sealing, and a drop of red epoxy resin is applied on one point between the case and the cover, configured to dry and then be broken when applying a weak force to open the cover.

According to another embodiment, the cover is configured to be removed automatically, upon sensing an environmental change, one of: temperature; humidity; water pressure; air pressure; electromagnetic radiation; vibration; acceleration; or a combination thereof. Such an automatic removal of the cover is crucial for accidents where the person is not in a condition to manipulate. In particular, automatic removal of the cover upon immersion in water is important in the marine field, specifically concerning a Man Over Board (MOB) accident.

For MOB use, it is desirable that the device cover would be removed automatically, after been immersed in water for a minimum period of time. This can be configured in several ways, based on the helical spring force that constantly presses the cover away from the case. One way is to provide a cover that dissolves in water; another way is to attach the cover to the case with strings or bands that dissolve in water, obviously avoiding a screw thread; a third alternative is to release safety pins, on the perimeter of the cover, using small electrical motors, activated by a water sensor; a fourth method is based on chemical compounds, that when mixed with water, provide a corrosive material that melts strings or bands that keep the cover closed; according to a fifth method, string or cords that keep the cover closed, are cut by miniature mechanical cutters; a sixth method is based on air or gas pressure, provided by a small internal container that is opened controlled by a sensor that detects immersion in water for a couple of minutes. Such a sensor can be placed in a small cavity in the case, configured with openings enabling the water to slowly enter, and the sensor configured to be activated only after the cavity is fully filled with water, which is calculated to take 2-3 minutes. This way, false alarms are reduced, avoiding activation when washing hands or when exposed to occasional splashes of waves. Nonetheless, the exact method for automatically removing the cover upon been immersed in water is not in the scope of the present invention.

According to the preferred embodiment of the present invention, the communication device is a Personal Locator Beacon (PLB), comprising an RF transmitter coupled to the helical antenna, configured to transmit periodic distress messages, upon activation. This RF transmitter and this helical antenna are tuned to the 406 MHz band, configured to communicate with satellites orbiting above the earth, of the constellation and according to the specifications of Cospas-Sarsat. Those technical specifications are detailed in the following document:

SPECIFICATION FOR COSPAS-SARSAT 406 MHz DISTRESS BEACONS

C/S T.001; Issue 3—Revision; 9 Oct. 2008

Which can be found at—http://vww.cospas-sarsat.com/DocumentsTSeries/TIOCT30.08_CompleteDoc.pdf So preferably, this device is configured as a SAR radio beacon, and according to the Cospas-Sarsat terminology (which is also a generic terminology), this device complies with the requirements for: Personal Locator Beacon (PLB); Emergency Position Indicating Radio Beacon (EPIRB); Emergency Locator Transmitter (ELT); or Ship Security Alert System (SSAS).

Further, according to the preferred embodiment, the communication device is configured to be worn by or attached to a person, wherein the ground plane of the device is placed between the human body and the helical antenna, as shown in FIG. 4. This way, the human arm interference to the antenna tuning and gain is kept relatively low. Such a wrist worn device is particularly beneficial for SAR applications since it is always accessible and available, while minimally disturbing during outdoor activities, such as sailing or skiing or climbing. Specifically, such a wrist worn device can be attached to a person onboard a vessel, and when said person falls overboard, said device is configured to transmit emergency signals indicating an MOB accident.

The PLB may further comprise a man-machine interface (MMI), enabling a user to input commands to the PLB, and the PLB to output status indications to a user. The preferred embodiment of the invention is related to SAR, so it is paramount to provide a PLB simple as possible for operation. In this context, the PLB is preferably configured to operate with a minimal intervention of a user. Thus, the device is activated by a micro switch sensing that the antenna cover was been removed. Then, a few outputs are provided, possibly audible or visible or touchable, but preferably visible, by means of Light Emitting Diodes (LEDs), configured to signal the user that: a) the radio is about to transmit or/and is actually transmitting; or/and b) its radio transmission was been acknowledged.

A PLB, by definition, including the PLB according to the preferred embodiment, is configured to be located. The Cospas-Sarsat system can locate the beacon RF signal, by measuring its Doppler frequency shift, or by demodulating the received signal and decoding the position data inserted by the beacon. For the latter method, it is required from the PLB to comprise a Global Navigation Satellite System (GNSS) receiver. Such GNSS can be, for example, the US GPS, the Russian GLONASS or the emerging European GALILEO. FIG. 6 shows a block diagram of a communication device, i.e. a PLB, according to a preferred embodiment of the invention. The figure depicts a microcontroller coupled to a GPS receiver and to an RF transmitter in the 406 MHz band. The GPS receiver is coupled to the planar antenna, however via a SAW filter, and the RF transmitter is coupled to the helical antenna. As a person skilled in the art may appreciate, there are many components presently in the market to implement a microprocessor, a 406 MHz transmitter or a GPS receiver.

Clearly, a GNSS receiver requires a matching antenna. So in addition to the helical antenna which is coupled to the RF transmitter, a second planar antenna is configured to serve the GNSS, said antenna is placed over the same ground plane that serves the helical antenna, wherein the planar antenna is substantially parallel to said ground plane and substantially close to said ground plane, and the footprint of said planar antenna on said ground plane does not exceed the footprint of said helical antenna base on the same ground plane. FIG. 3 shows these antennas, collocated according to the present invention: a helical antenna and a planar antenna placed over a ground plane.

There are many methods to implement a planar antenna, including: patch; microstrip; chip; folded strip; loop; spiral; meanderline; L shaped; F shaped; T shaped; U shaped; slot; two dimensional helical; or a combination thereof. According to the preferred embodiment of the invention, the GNSS receiver is a GPS receiver, and the coupled planar antenna is a patch passive antenna, measuring approximately 25×25 mm, tuned to a center frequency of 1575 MHz. As a skilled person in the art may appreciate, several types of such patch antennas are provided in the market for GPS receivers. The preferred embodiment, been a Cospas-Sarsat PLB, transmits, when activated, a short burst (about 520 ms) at 5 watts, on 406 MHz, every period of about 50 seconds. Then, since the planar and helical antennas are quite close to each other, the PLB further comprises a filter between the GPS receiver and the planar antenna, protecting the GPS receiver from high power radiated by the helical antenna. This filter can be a high-pass filter or band-pass filter. As a skilled person may appreciate, such a filter can be implemented either by SAW technology, as indicated in FIG. 6, or by conventional electronic components. In addition, the microcontroller may momentarily disable the GPS receiver, during the helical antenna transmission, in order to avoid even a residual interference.

FIG. 5 shows an overview of the disclosed device in relation to GPS and Cospas-Sarsat satellites. The figure shows the wrist worn PLB, comprising two antennas placed over a ground plane; the planar antenna receives signals transmitted by the GPS satellites, and the helical antenna transmits signals to a Cospas-Sarsat SAR Satellite. As a skilled person may appreciate, the 406 MHz transmitter and the GPS receiver may be placed on the lower side of the ground plane.

At the time this document is filed, the European GNSS Galileo is not operational yet. Still, Galileo is planned to transmit navigation messages, as GPS satellites do, but also receive and relay to earth radio beacons transmissions, as Cospas-Sarsat satellites do. In addition, Galileo satellites are planned to transmit acknowledgements to distress transmissions, probably to be detected by Galileo receivers. Then, according to a second embodiment of the present invention, the GNSS receiver in the PLB is a Galileo receiver, so a Galileo satellite that detects this PLB transmission could acknowledge it by communicating a proper message via the Galileo receiver embedded in this PLB. Then, the device would blink the acknowledgement LED, providing a user in distress a significant relief.

The invention is further directed to an antenna assembly comprising at least a helical antenna placed over a ground plane, packaged in a case with a rigid cover, said helical antenna axis substantially perpendicular to said ground plane and said helical antenna base substantially close to said ground plane, said ground plane size at least of a circle having a diameter not less than the helical antenna diameter, said helical antenna made of an elastic conductive spring configured to change its height along its axis, at least: a) pressed down between said case and cover achieving a low profile; or b) extended to a higher height improving antenna gain upon removing said cover, wherein the antenna is extended upon removing said cover only by means of its own spring force, and wherein the helical antenna radius is either constant or decreases as going far from said ground plane.

The invention is also directed to a method for fitting an antenna for a personal communication device, comprising the steps of:

i) providing a case and a matching rigid cover;

ii) providing a helical antenna made of an elastic conductive spring, placed over a ground plane;

iii) placing said helical antenna axis substantially perpendicular to said ground plane and said helical antenna base substantially close to said ground plane;

iv) configuring said ground plane to a size at least of a circle having a diameter not less than the helical antenna diameter;

v) configuring said antenna radius constantly or decreasing as going far from said ground plane;

vi) placing said antenna and ground plane in said case, configuring said antenna height to vary along its axis, at least: a) pressed down between said case and cover achieving a low profile; or b) extended to a higher height improving antenna gain upon removing said cover;

vii) configuring said antenna to extend to said higher height only by means of its own spring force, when the cover is removed.

According to one aspect of the invention, the presently disclosed device is a wrist-worn PLB, worn by a skier or hiker or hunter or canoer. When this person is in distress, he removes the PLB cover, turning it counterclockwise, breaking a weak epoxy seal, enabling the helical antenna to extend upwards. The device automatically turns on, by a micro switch that senses that the cover is removed. Then, within less than a minute, the PLB starts to send periodical distress messages, containing its Identification Data (ID) and its GPS position. Meanwhile, the transmission led blinks, indicating that the device is active, and that it is about to transmit a distress message; some seconds afterwards, this led is put constantly on, for 1-2, seconds, indicating that the device is actually transmitting. The person in distress may then carefully monitor the transmission led and when it blinks or stays on, keep the helical antenna pointed upwards, for about 5 seconds in order to assure optimal transmission conditions. During transmission, the person in distress preferably places himself away from any obstacle that might prevent a line of sight (LOS) with the satellites, such as trees, boulders, ice walls and so on.

According to another aspect of the invention, the presently disclosed device is a waterproof wrist-worn PLB, worn by a person onboard a vessel; when said person accidentally falls overboard, and the PLB is immersed in the water for at least 3 minutes, the PLB cover is automatically removed, then the helical antenna extends perpendicularly to the wrist, to about 6 centimeters. A micro switch that senses that the cover was removed automatically activates the device. Then, the PLB microcontroller blinks the transmission led for 5 seconds every cycle of 50 seconds, indicating the user to try, as possible, to keep his wrist out of the water at least at the 2 seconds when the transmission led is constantly on, pointing the helical antenna upwards. After some minutes, one of these distress transmissions is detected by a Cospas-Sarsat payload onboard a Galileo satellite and an acknowledgement message is broadcast in return. The Galileo receiver in the PLB detects this acknowledgement, and as soon as the microcontroller is aware of that, it blinks the acknowledgement led. The poor MOB, noting this glorious indication, may now concentrate on surviving and pay less care to his radio beacon.

The above examples and description have of course been provided only for the purpose of illustration, and are not intended to limit the invention in any way. As will be appreciated by the skilled person, the invention can be carried out in a great variety of ways, employing more than one technique from those described above, all without exceeding the scope of the invention. In this context, though the invention specifically refers to the Cospas-Sarsat system, it is definitely not bounded to this particular system, and its scope is well beyond any specific satellite communication or navigation system or any specific radio beacon type or system.

The invention claimed is:

1. A personal communication device comprising at least a helical antenna placed over a ground plane, packaged in a case with a rigid cover, said helical antenna axis substantially perpendicular to said ground plane and said helical antenna base substantially close to said ground plane, said ground plane size at least of a circle having a diameter not less than the helical antenna diameter, said helical antenna made of an elastic conductive spring configured to change its height along its axis, at least: a) pressed down between said case and said cover achieving a low profile; or b) extended to a higher height improving antenna gain upon removing said cover, wherein the antenna is extended upon removing said cover only by means of its own spring force, and wherein the extended helical antenna radius is either constant or decreases as the distance from the ground plane increases, wherein the device is configured to be worn by or attached to a person, and said ground plane is placed between the human body and the helical antenna.

2. A device according to claim 1, said helical antenna comprising either one or multiple helical conductors, also known as arms, each extended arm coiled around the antenna axis in a radius decreasing as the distance from the ground plane increases, over a spherical surface.

3. A device according to claim 1, wherein at least one non conductive cord is connected between one of the antenna coils and the case, said cord configured to be stowed when the antenna is pressed down and mechanically support the antenna when extended.

4. A device according to claim 1, wherein said cover is round shaped, configured with a screw thread matching another screw thread on said case, enabling an operator to remove the cover from the case by turning it counterclockwise.

5. A device according to claim 1, wherein said cover is configured to be removed automatically, upon sensing an environmental change, one of: temperature; humidity; water pressure; air pressure; electromagnetic radiation; vibration; acceleration; or a combination thereof.

6. A device according to claim 1, wherein said antenna is configured to radiate in circular polarization or/and elliptical polarization.

7. A device according to claim 1, wherein each of said helical antenna circumference and height are less than 25% of the wavelength transmitted or received by this antenna.

8. A device according to claim 1, further comprising a radio which is either a transmitter or receiver or transceiver, wherein said radio is coupled to said helical antenna.

9. A device according to claim 1, further comprising an RF transmitter coupled to said helical antenna, configured to transmit periodic distress messages, upon activation.

10. A device according to claim 8, wherein said radio is configured to communicate with at least one satellite orbiting above the earth.

11. A device according to claim 9, further comprising output means either audible or visible or touchable or a combination thereof, said output means configured to signal the user that: a) the radio is about to transmit or/and is actually transmitting; or/and b) its radio transmission was been acknowledged.

12. A device according to claim 9, configured as a radio beacon for Search and Rescue (SAR), one of: Personal Locator Beacon (PLB); Emergency Position Indicating Radio Beacon (EPIRB); Emergency Locator Transmitter (ELT); Ship Security Alert System (SSAS), compatible with the COSPAS-SARSAT satellite system.

13. A device according to claim 9, configured to be worn by or attached to a person onboard a vessel, and when said person falls overboard, said device is configured to transmit emergency signals, wherein said cover is configured to be removed automatically, after been immersed in water for a minimum period of time.

14. A device according to claim 1, further comprising a second planar antenna over said ground plane, said planar antenna substantially parallel to said ground plane and substantially close to said ground plane, wherein the footprint of said planar antenna on said ground plane does not exceed the footprint of said helical antenna base on the same ground plane.

15. A device according to claim 14, wherein said planar antenna is one of: patch; microstrip; chip; folded strip; loop; spiral; meanderline; L shaped; F shaped; T shaped; U shaped; slot; two dimensional helical; any two dimensional pattern; or a combination thereof.

16. A device according to claim 14, further comprising a Global Navigation Satellite System (GNSS) receiver coupled to said planar antenna.

17. A device according to claim 16, further comprising a filter between the GNSS receiver and the planar antenna, protecting the GNSS receiver from high power radiated by said helical antenna.

18. An antenna assembly comprising at least a helical antenna placed over a ground plane, packaged in a case with a rigid cover, said helical antenna axis substantially perpendicular to said ground plane and said helical antenna base substantially close to said ground plane, said ground plane size at least of a circle having a diameter not less than the helical antenna diameter, said helical antenna made of an elastic conductive spring configured to change its height along its axis, at least: a) pressed down between said case and cover achieving a low profile; or b) extended to a higher height improving antenna gain upon removing said cover, wherein the antenna is extended upon removing said cover only by means of its own spring force, and wherein the helical antenna radius is either constant or decreases as going far from said ground plane, wherein the antenna assembly is configured to be worn by or attached to a person, and said ground plane is placed between the human body and the helical antenna.

19. A method for fitting an antenna in a communication device, comprising the steps of:

i) providing a case and a matching rigid cover;

ii) providing a helical antenna made of an elastic conductive spring, placed over a ground plane;

iii) placing said helical antenna axis substantially perpendicular to said ground plane and said helical antenna base substantially close to said ground plane;

iv) configuring said ground plane to a size at least of a circle having a diameter not less than the helical antenna diameter;

v) configuring said antenna radius constantly or decreasing as going far from said ground plane;

vi) placing said antenna and said ground plane in said case, configuring said antenna height to vary along its axis, at least: a) pressed down between said case and said cover achieving a low profile; or b) extended to a higher height improving antenna gain upon removing said cover;

vii) configuring said antenna to extend to higher height only by means of its own spring force, when the cover is removed;

viii) configuring said communication device to be worn by or attached to a person, and placing said ground plane between the human body and the helical antenna.

* * * * *